US011772387B2

(12) United States Patent
Kiguchi

(10) Patent No.: US 11,772,387 B2
(45) Date of Patent: Oct. 3, 2023

(54) THERMAL HEAD AND THERMAL PRINTER

(71) Applicant: KYOCERA CORPORATION, Kyoto (JP)

(72) Inventor: Shinichi Kiguchi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 153 days.

(21) Appl. No.: 17/598,214

(22) PCT Filed: Mar. 17, 2020

(86) PCT No.: PCT/JP2020/011621
§ 371 (c)(1),
(2) Date: Sep. 24, 2021

(87) PCT Pub. No.: WO2020/196078
PCT Pub. Date: Oct. 1, 2020

(65) Prior Publication Data

US 2022/0176712 A1 Jun. 9, 2022

(30) Foreign Application Priority Data

Mar. 26, 2019 (JP) ..... 2019-058660

(51) Int. Cl.
*B41J 2/335* (2006.01)
*B41J 2/35* (2006.01)

(52) U.S. Cl.
CPC ..... *B41J 2/3351* (2013.01); *B41J 2/3354* (2013.01); *B41J 2/3357* (2013.01); *B41J 2/35* (2013.01)

(58) Field of Classification Search
CPC ..... B41J 2/3351; B41J 2/3354; B41J 2/3357; B41J 2/35
See application file for complete search history.

(56) References Cited

FOREIGN PATENT DOCUMENTS

| | | | | | |
|---|---|---|---|---|---|
| JP | S61192847 | U | | 12/1986 | |
| JP | 2003200605 | A | | 7/2003 | |
| JP | 201743013 | A | | 3/2017 | |
| JP | 2017043013 | A | * | 3/2017 | ..... B41J 2/335 |

* cited by examiner

*Primary Examiner* — Yaovi M Ameh
(74) *Attorney, Agent, or Firm* — HAUPTMAN HAM, LLP

(57) ABSTRACT

A thermal head includes a substrate, a plurality of heat generating portions, electrodes, pads, driving ICs, and a wire. The plurality of heat generating portions are positioned on the substrate and arranged in a main scanning direction. The electrodes are positioned on the substrate and electrically coupled to each of the plurality of heat generating portions. The pads are positioned on the substrate and coupled to the electrodes. The driving ICs drive the heat generating portions. The wire couples the driving ICs and the electrodes to each other. The thermal head according to the present disclosure includes a plurality of the pads. At least one of the pads is a multi pad that has a first region to which the wire is connected and a second region to which each of a plurality of probes is connected.

12 Claims, 8 Drawing Sheets

THERMAL HEAD AND THERMAL PRINTER

RELATED APPLICATIONS

The present application is a National Phase of International Application Number PCT/JP2020/011621 filed Mar. 17, 2020 and claims priority to Japanese Application Number 2019-058660 filed Mar. 26, 2019.

TECHNICAL FIELD

The present invention relates to a thermal head and a thermal printer.

BACKGROUND ART

As image printing devices, such as facsimile machines or video printers, various thermal heads have been proposed. For example, a thermal head that includes a substrate, a plurality of heat generating portions, an electrode, a pad, a driving IC, and a wire is known. The plurality of heat generating portions are positioned on the substrate and arranged in a main scanning direction. The electrode is positioned on the substrate and electrically coupled to each of the plurality of heat generating portions. The pad is positioned on the substrate and coupled to the electrode. The driving IC drives the heat generating portions. The wire couples the driving IC and the electrode to each other. In the thermal head, the pad has a first region to which the wire is connected and a second region to which a probe is connected (refer to, for example, PTL 1).

CITATION LIST

Patent Literature

PTL 1: Japanese Unexamined Utility Model Registration Application Publication No. 61-192847

SUMMARY OF INVENTION

A thermal head according to the present disclosure includes a substrate, a plurality of heat generating portions, an electrode, a pad, a driving IC, and a wire. The plurality of heat generating portions are positioned on the substrate and arranged in a main scanning direction. The electrode is positioned on the substrate and electrically coupled to each of the plurality of heat generating portions. The pad is positioned on the substrate and coupled to the electrode. The driving IC drives the heat generating portions. The wire couples the driving IC and the electrode to each other. The thermal head according to the present disclosure includes a plurality of the pads. At least one of the pads is a multi pad that has a first region to which the wire is connected and a second region to which each of a plurality of probes is connected.

The thermal printer according to the present disclosure includes the aforementioned thermal head, a transport mechanism that transports a recording medium onto the heat generating portions, and a platen roller that presses the recording medium.

DESCRIPTION OF EMBODIMENTS

First Embodiment

Figure 1:
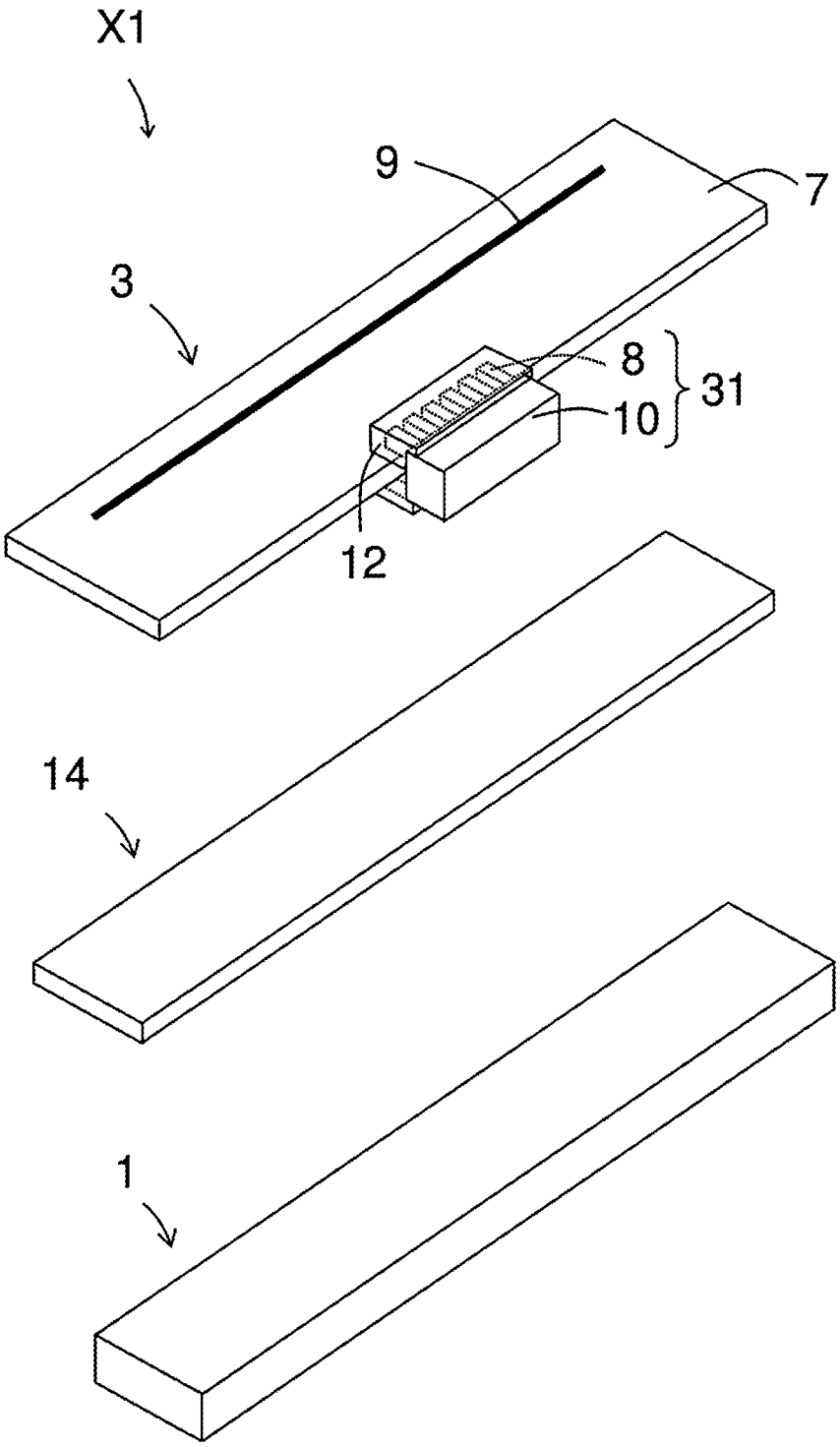
FIG. 1 is an exploded perspective view illustrating an outline of a thermal head according to the present disclosure.
Figure 2:
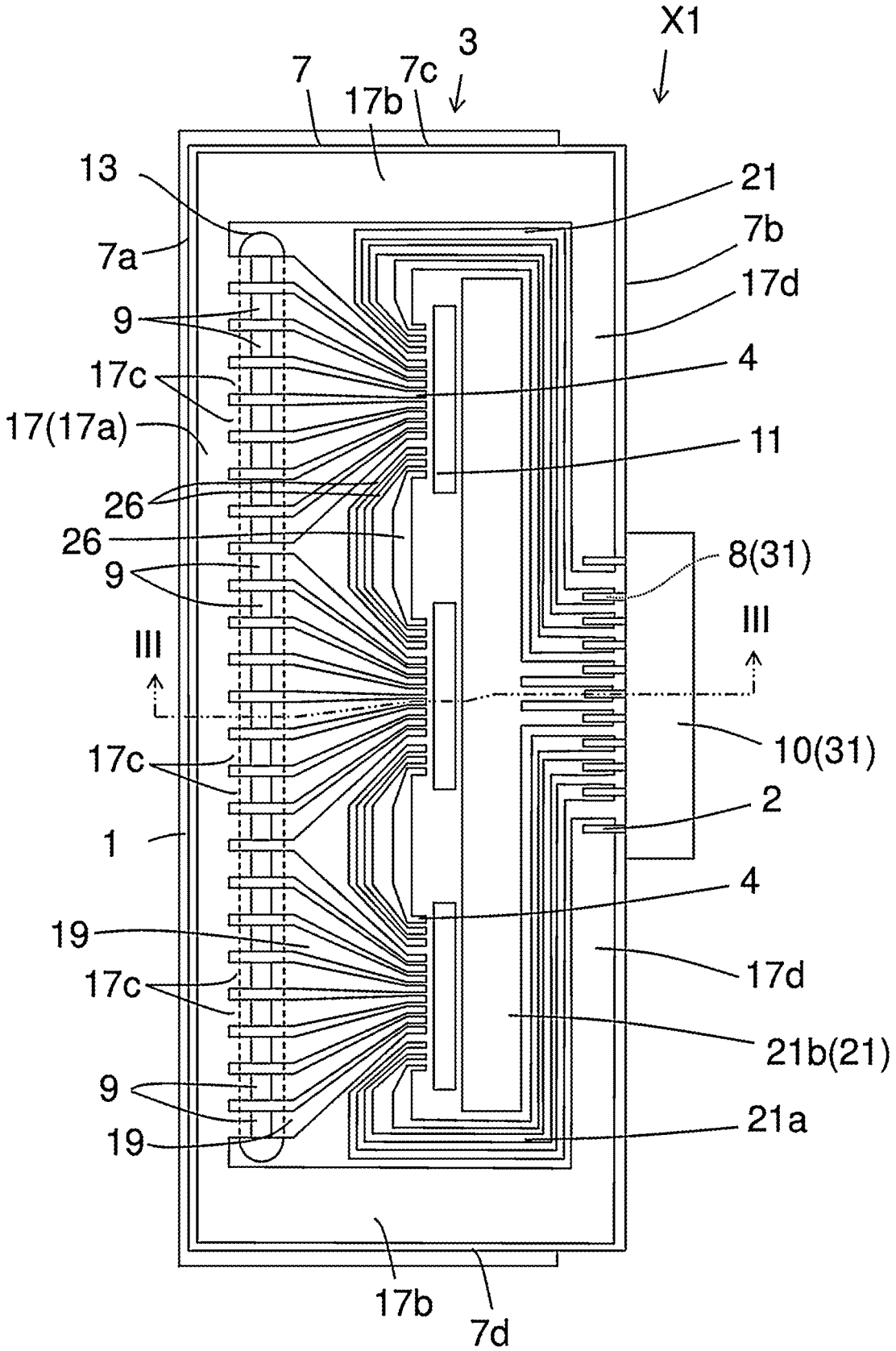
FIG. 2 is a plan view of the thermal head illustrated in FIG. 1.

Hereinafter, a thermal head X1 will be described with reference to FIG. 1 to FIG. 5. FIG. 1 schematically illustrates a configuration of the thermal head X1 in which a protective layer 25, a cover layer 27, and a cover member 29 are omitted. In FIG. 2, the protective layer 25, the cover layer 27, the cover member 29, and a sealing member 12 are omitted. In addition, an outline of the positional relationship between individual electrodes 19 and a multi pad 16 is illustrated.

The thermal head X1 includes a head base 3, a connector 31, the sealing member 12, a heat dissipation plate 1, and an adhesive member 14. In the thermal head X1, the head base 3 is positioned on the heat dissipation plate 1 with the adhesive member 14 interposed therebetween. By being applied with a voltage from outside, the head base 3 causes heat generating portions 9 to generate heat to perform image printing on a recording medium (not illustrated). The connector 31 electrically connects the head base 3 to the outside. The sealing member 12 joins the connector 31 and the head base 3 to each other. The heat dissipation plate 1 dissipates heat of the head base 3. The adhesive member 14 bonds the head base 3 and the heat dissipation plate 1 to each other.

The heat dissipation plate 1 has a rectangular parallelepiped shape. A substrate 7 is positioned on the heat dissipation plate 1. The heat dissipation plate 1 is made of, for example, a metal material such as copper, iron, or aluminum.

The head base 3 has a rectangular parallelepiped shape. Members that constitute the thermal head X1 are positioned on the substrate 7 of the head base 3. The head base 3 performs image printing on a recording medium (not illustrated) in accordance with an electric signal supplied from the outside.

The connector 31 is electrically connected to the head base 3 and electrically connects the head base 3 to an external power source. The connector 31 includes a plurality of connector pins 8 and a housing 10 that houses the plurality of connector pins 8. The plurality of connector pins 8 are positioned on the upper side and the lower side of the substrate 7 and hold the substrate 7. The connector pins 8 disposed on the upper side are electrically coupled to terminals 2 (refer to FIG. 2) of the head base 3.

The sealing member 12 is provided so that the terminals 2 and the connector pins 8 are not exposed to the outside. The sealing member 12 is made of, for example, an epoxy-based heat-curable resin, an ultraviolet-curable resin, or a visible light-curable resin. The sealing member 12 improves strength of joint between the connector 31 and the head base 3.

The adhesive member 14 is positioned between the heat dissipation plate 1 and the head base 3 and joins the head base 3 and the heat dissipation plate 1 to each other. An example of the adhesive member 14 is a double-sided tape or a resin adhesive.

Hereinafter, members that constitute the head base 3 will be described with reference to FIG. 2 to FIG. 5.

The substrate 7 has a rectangular parallelepiped shape. The substrate 7 has one long side 7*a*, another long side 7*b*, one short side 7*c*, and another short side 7*d*. The substrate 7 is made of, for example, an electrically insulating material such as alumina ceramic, a semiconductor material such as a single crystal silicon, or the like.

A heat storage layer 13 is positioned on the substrate 7. The heat storage layer 13 includes a base portion 13*a* and a bulge portion 13*b*. The base portion 13*a* is positioned in the entire region of the upper surface of the substrate 7, and the bulge portion 13*b* projects upward from the base portion 13*a*.

The bulge portion 13*b* is positioned adjacent to the one long side 7*a* and extends in a belt shape in a main scanning direction. The sectional shape of the bulge portion 13*b* in a sub-scanning direction is substantially semi-elliptical. Due to the heat generating portions 9 being positioned on the bulge portion 13*b*, a recording medium P (refer to FIG. 5) is favorably pressed against the protective layer 25 that is positioned on the heat generating portions 9 by being pressed by a platen roller 50. An example of the thickness of the base portion 13*a* is 15 to 40 μm. An example of the thickness of the bulge portion 13*b* is 15 to 90 μm.

The heat storage layer 13 is formed of glass having low thermal conductivity and temporarily stores a portion of heat generated in the heat generating portions 9. Therefore, the temperature of the heat generating portions 9 does not excessively decrease, and a time required for increasing the temperature of the heat generating portions 9 can be shortened, which improves the thermal response characteristic of the thermal head X1. The heat storage layer 13 is produced by, for example, the following method. First, predetermined glass paste obtained by mixing an organic solvent with glass powder is produced. Next, the glass paste is applied onto the upper surface of the substrate 7 by known screen printing or the like and subjected to baking, and the heat storage layer 13 is thereby produced.

An electric resistance layer 15 is positioned at the upper surface of the substrate 7 and the upper surface of the heat storage layer 13. Various electrodes that constitute the head base 3 are positioned on the electric resistance layer 15. The electric resistance layer 15 is patterned into the same shape as the shape of the various electrodes that constitute the head base 3. The electric resistance layer 15 has exposure regions in which the electric resistance layer 15 is exposed between a common electrode 17 and the individual electrodes 19, and the exposure regions constitute the heat generating portions 9. A plurality of the heat generating portions 9 are arranged on the bulge portion 13*b* in the main scanning direction.

Although illustrated simply in FIG. 2 for convenience of description, the plurality of heat generating portions 9 are disposed at density of, for example, 100 dpi to 2400 dpi (dot per inch). The electric resistance layer 15 is made of, for example, a material having a relatively high electric resistance, such as a TaN-based material, a TaSiO-based material, a TaSiNO-based material, a TiSiO-based material, a TiSiCO-based material, or a NbSiO-based material. The heat generating portions 9 generate heat by Joule heating when being applied with a voltage.

The common electrode 17 includes main wiring portions 17*a* and 17*d*, sub wiring portions 17*b*, and lead portions 17*c*. The common electrode 17 electrically connects the plurality of heat generating portions 9 and the connector 31 to each other. The main wiring portion 17*a* extends along the one long side 7*a* of the substrate 7. The sub wiring portions 17*b* extend along the one short side 7*c* and the other short side 7*d* of the substrate 7, respectively. The lead portions 17*c* extend individually from the main wiring portion 17*a* toward the heat generating portions 9. The main wiring portion 17*d* extends along the other long side 7*b* of the substrate 7.

A plurality of the individual electrodes 19 electrically connect the heat generating portions 9 to driving ICs 11. The individual electrodes 19 divide the plurality of heat generating portions 9 into a plurality of groups and electrically connect the heat generating portions 9 of the groups to the driving ICs 11 provided in correspondence with the groups. A pad 4 is provided at an end portion of each of the individual electrodes 19. The pad 4 is electrically connected to the driving IC 11 disposed above the pad 4 via a wire 18.

A plurality of IC-connector connection electrodes 21 include a signal electrode 21*a* and a ground electrode 21*b*. The plurality of IC-connector connection electrodes 21 electrically connect the driving ICs 11 to the connector 31. The plurality of IC-connector connection electrodes 21 connected to the driving ICs 11 are constituted by a plurality of wires having different functions. The signal electrode 21*a* sends various signals to the driving ICs 11.

The ground electrode 21*b* is surrounded by the individual electrodes 19, the signal electrode 21*a*, and the main wiring portion 17*d* of the common electrode 17. The ground electrode 21*b* is held at a ground potential of 0 to 1 V.

The terminals 2 are provided on the side of the other long side 7*b* of the substrate 7 to connect the common electrode 17, the individual electrodes 19, the IC-connector connection electrodes 21, and the ground electrode 21*b* to the connector 31. The terminals 2 are positioned in correspondence with the connector pins 8, and the connector pins 8 and the terminals are connected to each other.

A plurality of IC-IC connection electrodes 26 electrically connect the mutually adjacent driving ICs 11 to each other. The plurality of IC-IC connection electrodes 26 are positioned in correspondence with the IC-connector connection electrodes 21 and transmit various signals to the mutually adjacent driving ICs 11.

Various electrodes that constitute the aforementioned head base 3 can be produced by, for example, the following method. First, material layers that constitute the various electrodes are sequentially stacked on the heat storage layer 13 by, for example, a known thin-film formation technique, such as sputtering. Next, the stacked body is processed into a predetermined pattern by known photoetching or the like, and the various electrodes are thereby produced. Various electrodes that constitute the head base 3 may be produced at the same time in the same step.

As illustrated in FIG. 2, the driving ICs 11 are positioned in correspondence with the groups of the plurality of heat generating portions 9. The driving ICs 11 are connected by the wire 18 to the other end portion of each of the individual electrode 19 and one end portion of each of the IC-connector connection electrodes 21. The driving ICs 11 have a function of controlling the energization state of the heat generating portions 9.

In a state of being connected to the individual electrodes 19, the IC-IC connection electrodes 26, and the IC-connector connection electrodes 21, the driving ICs 11 are sealed by the cover member 29. The cover member 29 can be made of a resin such as an epoxy resin or a silicone resin.

Figure 3:
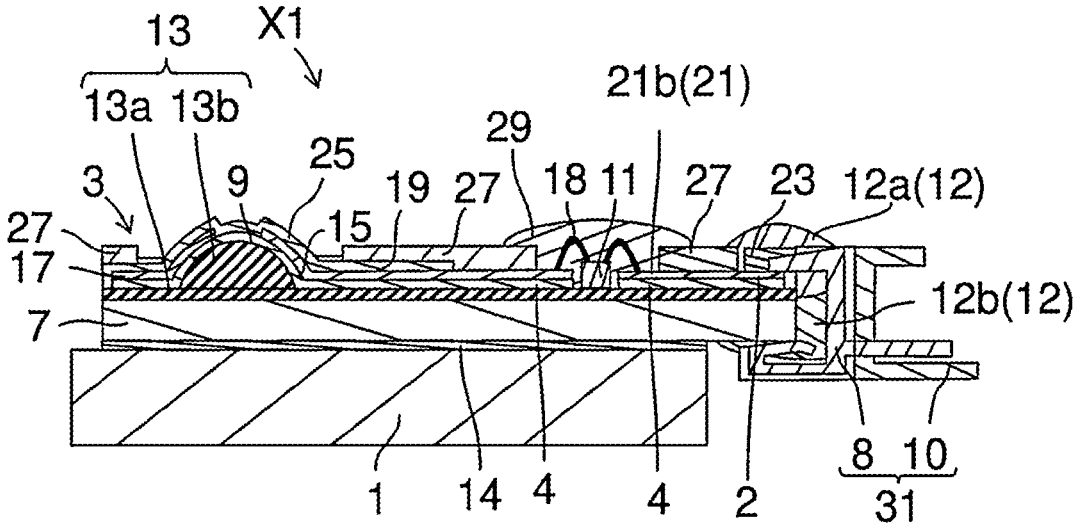
FIG. 3 is a sectional view along line III-III indicated in FIG. 2.

As illustrated in FIG. 3, the protective layer 25 that covers the heat generating portions 9, a portion of the common electrode 17, and a portion of the individual electrodes 19 is positioned on the heat storage layer 13 provided on the substrate 7.

The protective layer 25 seals covered regions of the heat generating portions 9, the common electrode 17, and the individual electrodes 19. The protective layer 25 protects the thermal head X1 from corrosion due to adhesion of moisture and the like contained in the atmosphere or from abrasion due to contact with a recording medium on which image printing is to be performed.

The protective layer 25 can be made of SiN, $SiO_2$, SiON, SiC, diamond-like carbon or the like. The protective layer 25 may be constituted by a single layer and may be constituted by single layers stacked on each other. The protective layer 25 can be produced by sputtering or the like, or screen printing or the like.

As illustrated in FIG. 3, the cover layer 27 that partially covers the common electrode 17, the individual electrodes 19, and the IC-connector connection electrodes 21 is provided on the substrate 7. The cover layer 27 covers most parts of the common electrode 17, the individual electrodes 19, the IC-IC connection electrodes 26, and the IC-connector connection electrodes 21. Consequently, the cover layer 27 has a function of protecting the various electrodes from oxidation due to contact with the atmosphere or from corrosion due to adhesion of moisture and the like contained in the atmosphere.

The connector 31 and the head base 3 are fixed by the connector pins 8, a joint member 23, and the sealing member 12. The joint member 23 is positioned between the terminal and the connector pins 8. The joint member 23 is, for example, a solder, an anisotropic conductive adhesive, or the like. The thermal head X1 will be described by using a solder as the joint member 23.

A plated layer (not illustrated) of Ni, Au, or Pd may be provided between the joint member 23 and the terminals 2. The joint member 23 may be not necessarily provided between the terminals 2 and the connector pins 8. In this case, by using the connector pins 8 of a clip type, the terminals 2 and the connector pins 8 can be electrically connected to each other directly by holding the substrate 7 by the connector pins 8.

The sealing member 12 includes a first sealing member 12*a* and a second sealing member 12*b*. The first sealing member 12*a* is positioned at the upper surface of the substrate 7. The second sealing member 12*b* is positioned at the side surface and the lower surface of the substrate 7. The first sealing member 12*a* seals the connector pins 8 and the various electrodes and fixes the connector pins 8 and the various electrodes to each other. The second sealing member 12*b* reinforces the joint between the connector 31 and the head base 3.

Figure 4:
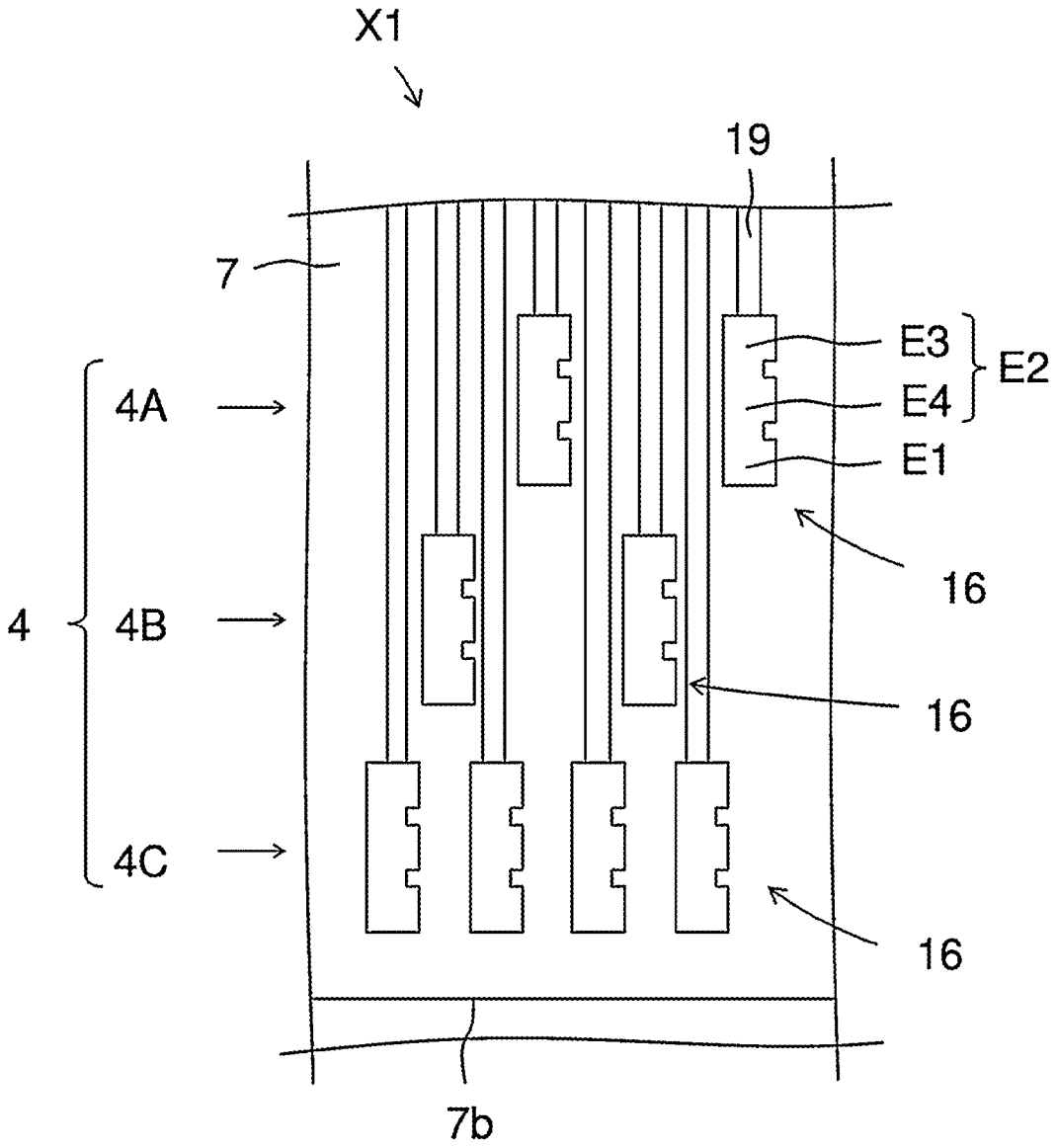
FIG. 4 is an enlarged plan view illustrating a portion of the thermal head illustrated in FIG. 1.
Figure 5:
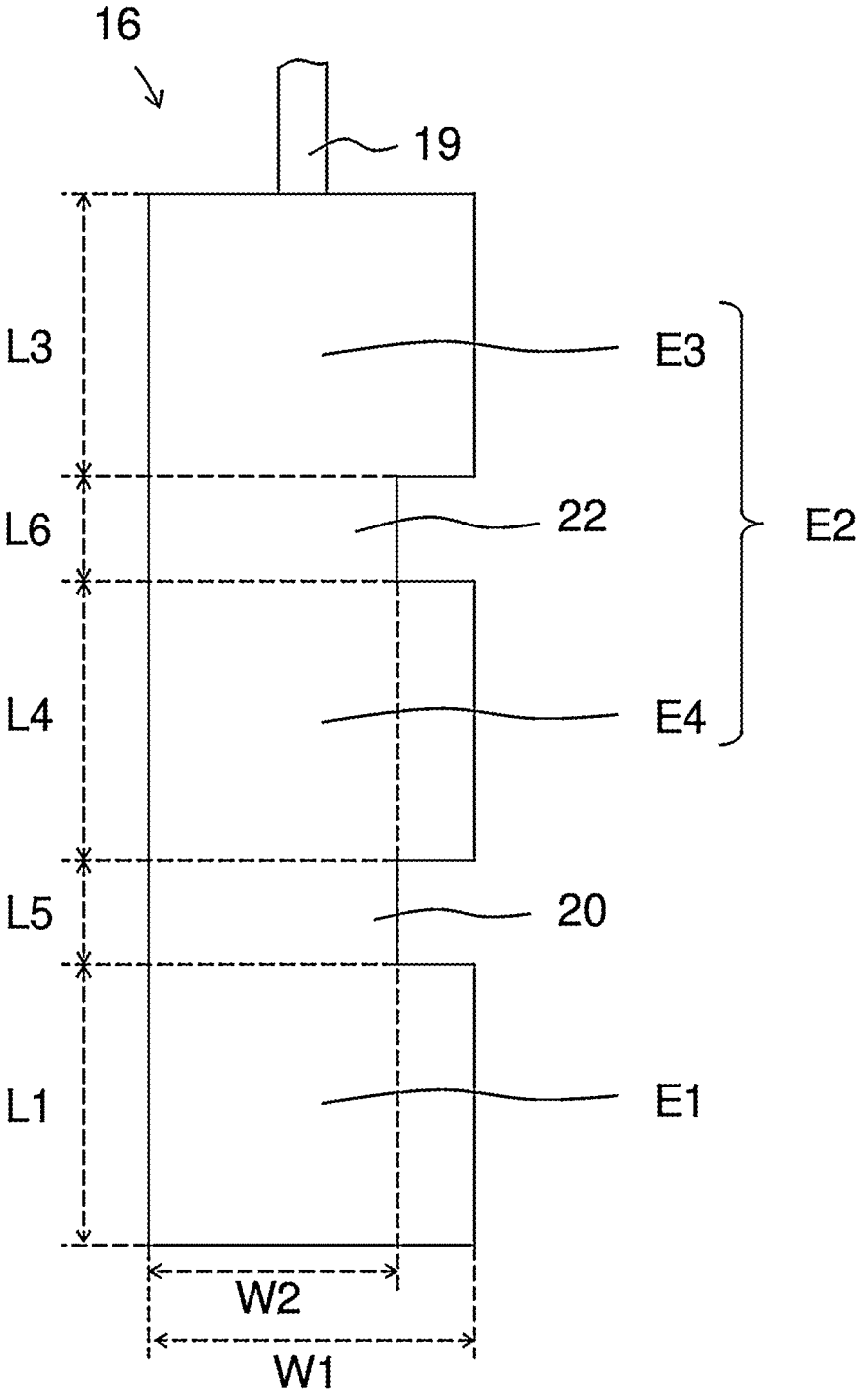
FIG. 5 is an enlarged plan view of a pad of the thermal head illustrated in FIG. 1.

With reference to FIG. 4 and FIG. 5, the pads 4 will be described in detail.

The pads 4 are the multi pads 16 each having a first region E1 and a second region E2. Hereinafter, the pads 4 will be described as the multi pads 16 in the present embodiment. The multi pads 16 are connected to end portions of the individual electrodes 19 and positioned closer than the individual electrodes 19 to the other long side 7*b* of the substrate 7. The multi pads 16 are electrically connected to the driving ICs 11 by the wire 18 (refer to FIG. 3).

The multi pads 16 have pad rows 4A to 4C arranged in the main scanning direction. The pad rows 4A to 4C are arranged in the sub-scanning direction. The pad rows 4A to 4C are arranged in the order of the pad row 4A, the pad row 4B, and the pad row 4C from the side close to the heat generating portions 9 (refer to FIG. 2). In the main scanning direction, the multi pads 16 that constitute the pad rows 4A and 4B are positioned between the multi pads 16 that constitute the pad row 4C.

As illustrated in FIG. 5, the multi pads 16 have the first region E1, the second region E2, a first narrow portion 20, and a second narrow portion 22. The second region E2 has a third region E3 and a fourth region E4.

The first region E1 is a region to which the wire 18 is connected. The second region E2 is a region to which each of a plurality of probes is connected. In the present embodiment, there are the third region E3 and the fourth region E4 to which two probes are connected, respectively. The third region E3 is a region to which a first probe is connected. The fourth region E4 is a region to which a second probe is connected.

The first region E1, the third region E3, and the fourth region E4 each have a rectangular shape in plan view. A width W1 (a length in the main scanning direction; hereinafter, the same applies) of each of the first region E1, the third region E3, and the fourth region E4 is, for example, 40 to 110 μm. A length L1 (a length in the sub-scanning direction; hereinafter, the same applies) of the first region E1, a length L3 of the third region E3, and a length L4 of the fourth region E4 are each, for example, 50 to 150 μm.

The first narrow portion 20 connects the first region E1 and the second region E2 to each other. More specifically, the first narrow portion 20 connects the first region E1 and the fourth region E4 to each other. The second narrow portion 22 connects the third region E3 and the fourth region E4 to each other. The width W2 of each of the first narrow portion 20 and the second narrow portion 22 is narrower than the width W1 of each of the first region E1 and the second region E2. The width W2 of each of the first narrow portion 20 and the second narrow portion 22 is, for example, 20 to 90 μm. A length L5 of the first narrow portion 20 and a length L6 of the second narrow portion 22 are, for example, 10 to 30 μm.

The multi pads 16 are connected to the individual electrodes 19. The parts that constitute the multi pads 16 are positioned in the order of the second region E2, the first narrow portion 20, and the first region E1 from the individual electrodes 19. More specifically, the part that constitute the multi pads 16 are positioned in the order of the third region E3, the second narrow portion 22, the fourth region E4, the first narrow portion 20, and the first region E1 from the individual electrodes 19.

The multi pads 16 thus each have a shape in which portions corresponding to the first narrow portion 20 and the second narrow portion 22 are constricted in plan view. In other words, the multi pads 16 each have cutouts at portions corresponding to the first narrow portion 20 and the second narrow portion 22. Consequently, when the wire 18 or the probes are to be connected, the first region E1 and the second region E2 are easily recognized. That is, it is possible to use the first narrow portion 20 and the second narrow portion 22 as markers for wire bonding and probing.

As described above, when cutouts are considered to be provided at positions corresponding to the first narrow portion 20 and the second narrow portion 22, the cutouts are provided only at one long side of the multi pads 16. Consequently, the area of each multi pad 16 is not excessively decreased by the cutout, and the wire 18 and the first region E1 can be stably electrically connected to each other.

Here, the probes are pressed against the second region E2 in the thermal head X1 to perform measurement of a resistance value of the heat generating portions 9, an open/short inspection, and other electrical inspections. In this case, a so-called probe trace may be generated on the second region E2.

In recent years, a demand for management of the resistance value of the thermal head X1 has been increased, and the aforementioned inspections may be performed multiple times. For example, when the second region E2 has only the third region E3, an electrical inspection is performed by connecting the first probe to the third region E3, and then, an electrical inspection is performed by connecting the second probe also to the third region E3. In this case, the probes are connected to the same third region E3 multiple times, and pad waste may be generated as a result of the third region E3 being turned up.

In contrast, in the thermal head X1, the multi pads 16 have the first region E1 to which the wire 18 is connected and the second region E2 to which each of the plurality of probes are connected. Consequently, the multi pads 16 have a region to which the wire is connected, a region to which the first probe is connected, and a region to which the second probe is connected, separately. Therefore, even when multiple times of resistance measurement, open/short inspections, and other electrical inspections are performed, the multi pads 16 are not easily turned up. As a result, the thermal head X1 is not easily broken.

In the multi pads 16, the first region E1 is positioned closer than the second region E2 to the driving ICs 11. In other words, the first region E1 is positioned closer than the second region E2 to the side of the other long side 7*b* of the substrate 7.

Such a configuration can shorten the distance between the first region E1 and the driving IC 11. As a result, the length of the wire 18 can be shortened. Therefore, the material costs of the wire 18 can be reduced. In addition, the work time of wire bonding can be shortened.

In the multi pads 16, the fourth region E4 may be positioned closer than the third region E3 to the side of the first region E1. With such a configuration, when the first probe performs an electrical inspection of the thermal head X1 and the second probe performs a pre-delivery resistance inspection of the thermal head X1, accuracy in the resistance inspection can be improved.

Next, a thermal printer Z1 will be described with reference to FIG. 6.

Figure 6:
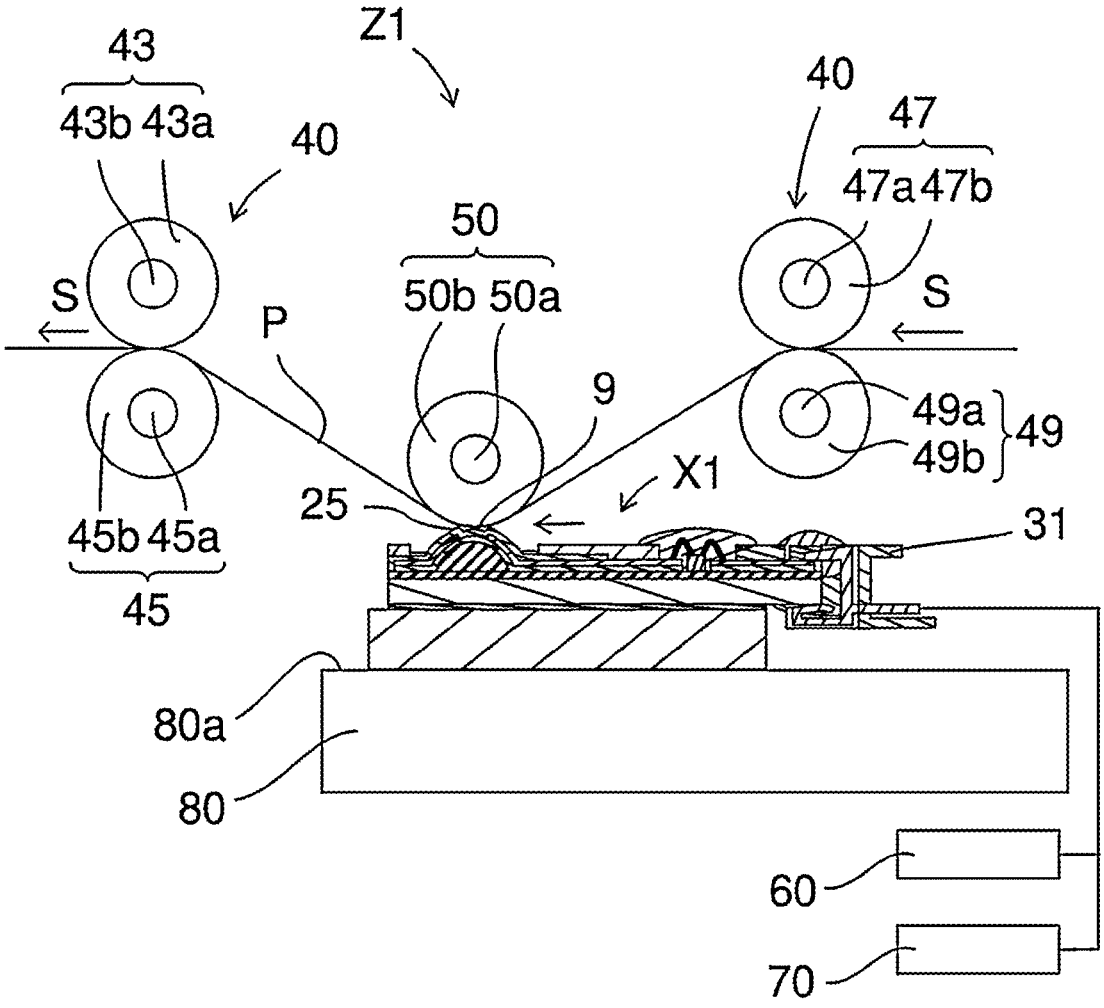
FIG. 6 is a schematic view illustrating a thermal printer according to the present disclosure.

As illustrated in FIG. 6, the thermal printer Z1 according to the present embodiment includes the above-described thermal head X1, a transport mechanism 40, the platen roller 50, a power source device 60, and a control device 70. Thermal head X1 is attached to an attachment surface 80*a* of an attachment member 80 provided at a housing (not illustrated) of the thermal printer Z1. The thermal head X1 is attached to the attachment member 80 to extend along a main scanning direction that is a direction orthogonal to a transport direction S of the recording medium P, which will be described later.

The transport mechanism 40 includes a driving unit (not illustrated) and transport rollers 43, 45, 47, and 49. The transport mechanism 40 is for transporting the recording medium P, such as thermal paper or image-receiving paper to which ink is to be transferred, in the arrow-S direction in FIG. 5 to transport the recording medium P onto the protective layer 25 positioned on the plurality of heat generating portions 9 of the thermal head X1. The driving unit has a function of driving the transport rollers 43, 45, 47, and 49. For example, a motor is usable as the driving unit. The transport rollers 43, 45, 47, and 49 can be constituted by, for example, a columnar shaft bodies 43*a*, 45*a*, 47*a*, and 49*a* that are made of metal such as stainless steel, and elastic members 43*b*, 45*b*, 47*b*, and 49*b* that are made of butadiene rubber or the like and that cover the shaft bodies. Although no illustration is provided, when the recording medium P is image-receiving paper or the like to which ink is to be transferred, an ink film is transported together with the recording medium P to a portion between the recording medium P and the heat generating portions 9 of the thermal head X1.

The platen roller 50 has a function of pressing the recording medium P against the protective layer 25 positioned on the heat generating portions 9 of the thermal head X1. The platen roller 50 is disposed to extend in a direction orthogonal to the transport direction S of the recording medium P and is supported and fixed at both end portions thereof to be rotatable in a state of pressing the recording medium P against the heat generating portions 9. The platen roller 50 can be constituted by, for example, a columnar shaft body 50*a* that is made of metal such as stainless steel, and an elastic member 50*b* that is made of butadiene rubber or the like and that covers the shaft body 50*a*.

The power source device 60 has a function of supplying current for causing the heat generating portions 9 of the thermal head X1 to generate heat, and current for causing the driving ICs 11 to operate as described above. The control device 70 has a function of supplying a control signal that controls the operation of the driving ICs 11 to the driving ICs 11 to selectively cause the heat generating portions 9 of the thermal head X1 to generate heat as described above.

In the thermal printer Z1, while the recording medium P is transported on the heat generating portions 9 by the transport mechanism 40 with the recording medium P being pressed against the heat generating portions 9 of the thermal head X1 by the platen roller 50, the heat generating portions 9 are selectively caused by the power source device 60 and the control device 70 to generate heat, and predetermined image printing is thereby performed on the recording medium P. When the recording medium P is image-receiving paper or the like, image printing with respect to the recording medium P is performed by thermally transferring, to the recording medium P, ink of an ink film (not illustrated) that is transported together with the recording medium P.

Figure 7:
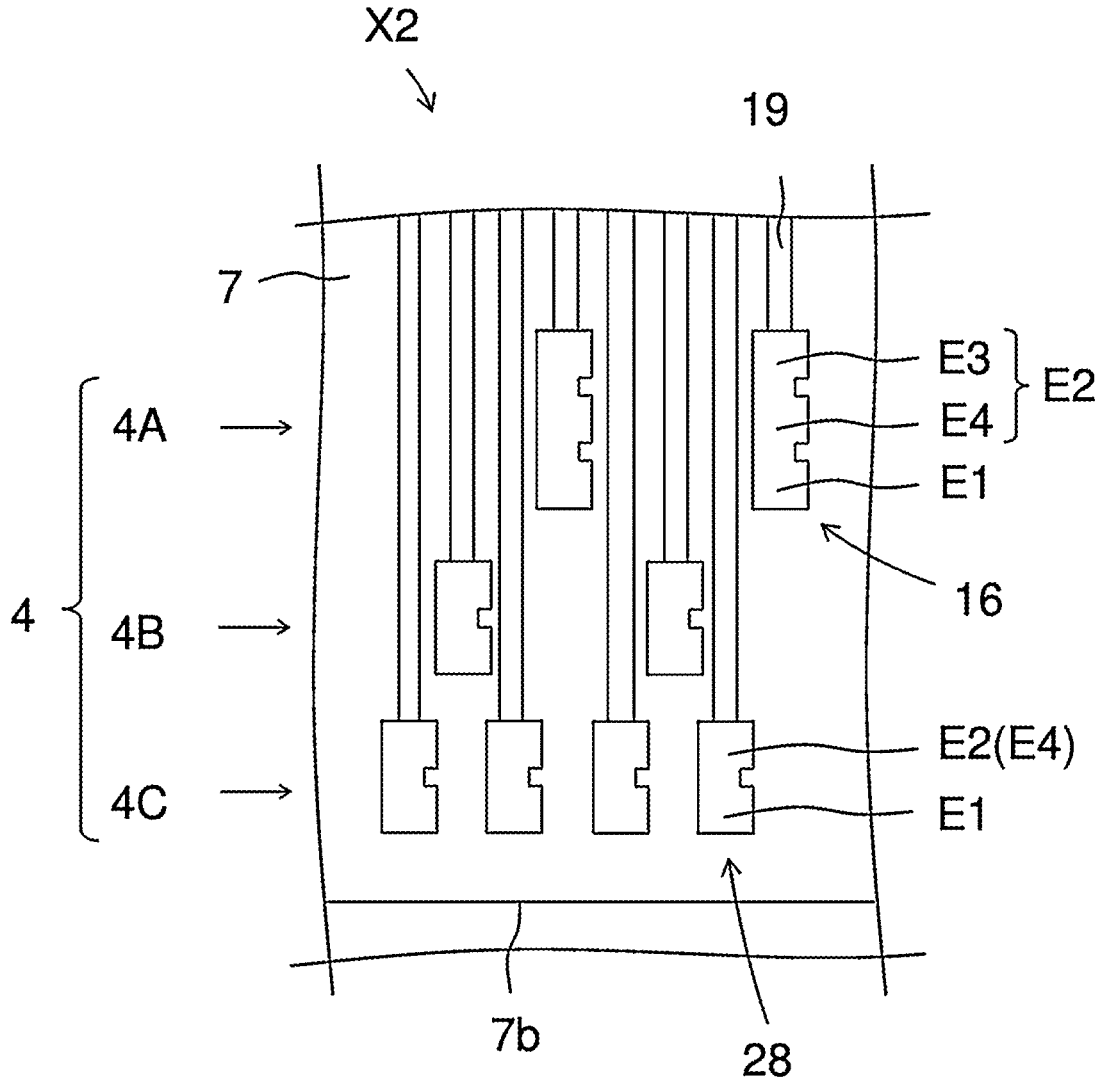
FIG. 7 is an enlarged plan view illustrating a portion of another thermal head.

With reference to FIG. 7, a thermal head X2 according to another embodiment will be described. The same members as the members of the thermal head X1 are given the same signs. the same applies to the followings.

The thermal head X2 includes, as the pads 4, the multi pads 16 and single pads 28. The pad row 4A is constituted by the multi pads 16. The pad rows 4B and 4C are constituted by the single pads 28.

The single pads 28 have the first region E1 and the second region E2. The first region E1 is a region to which the wire 18 is connected. The second region E2 is a region to which the second probe is connected. That is, the second region E2 of the single pads 28 corresponds to the fourth region of the multi pads 16. The second region E2 of the single pads 28 has only one region to which a probe is connected. The length of each of the single pads 28 is thus shorter than the length of each of the multi pads 16.

In the thermal head X2, the pad row 4A is constituted by the multi pads 16, and the pad rows 4B and 4C are constituted by the single pads 28. Such a configuration can shorten the lengths of the pad rows 4B and 4C in the sub-scanning direction. As a result, the pad rows 4A and 4B can be placed close to the other long side 7*b* of the substrate 7. Consequently, the thermal head X2 can be downsized. In addition, the length of the wire 18 (refer to FIG. 3) can be shortened. Therefore, the material costs of the wire 18 can be reduced. In addition, the work time of wire bonding is shortened.

Due to the pad row 4A being constituted by the multi pads 16, the thermal head X1 can perform the first probe and the second probe.

Figure 8:
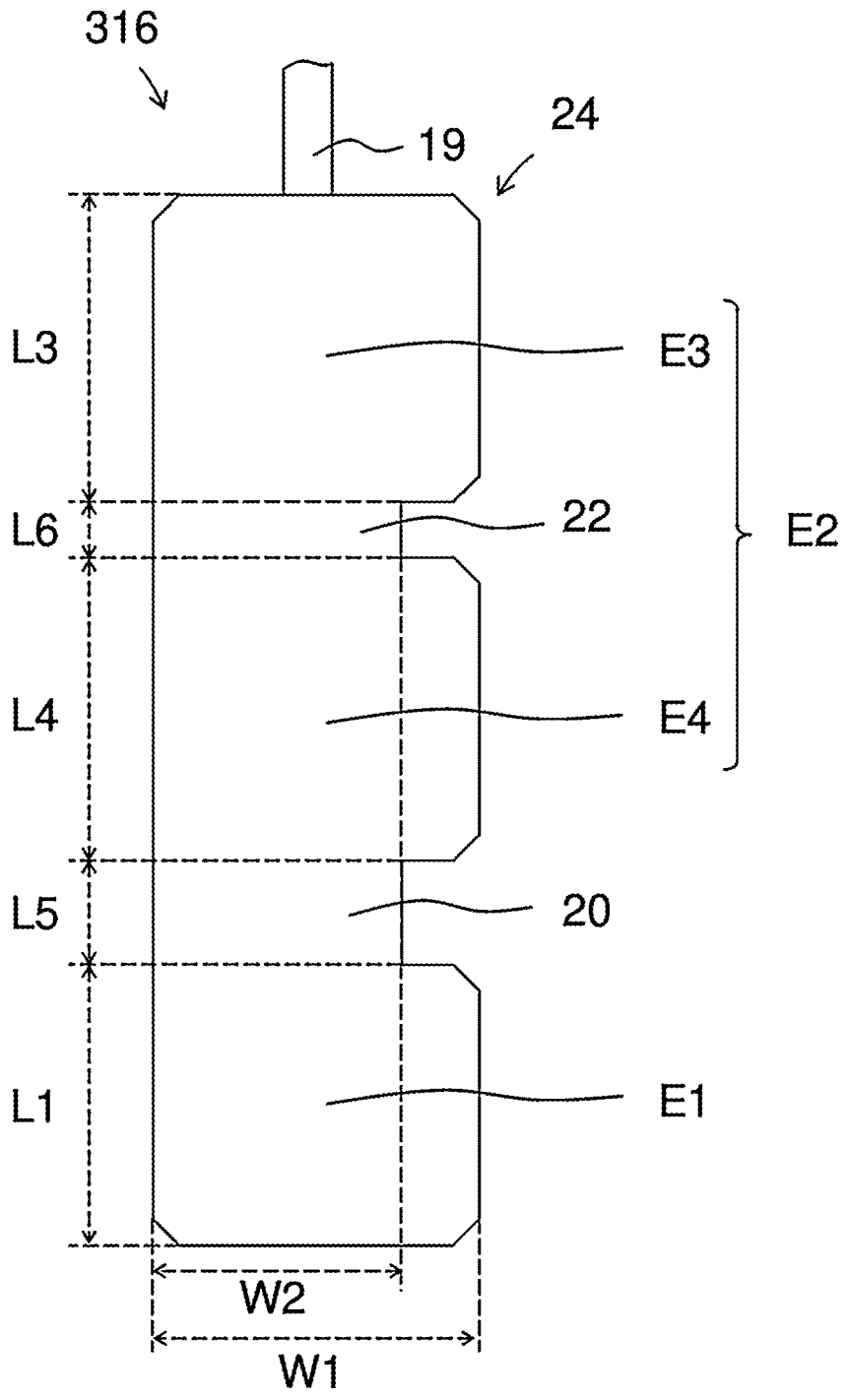
FIG. 8 is an enlarged plan view illustrating a pad of the other thermal head.

With reference to FIG. 8, another embodiment of a multi pad 316 will be described.

The multi pad 316 has the first region E1, the second region E2, the first narrow portion 20, and the second narrow portion 22. The second region E2 has the third region E3 and the fourth region E4.

The length L3 of the third region E3 and the length L4 of the fourth region E4 are longer than the length L1 of the first region E1. The length L3 of the third region E3 and the length L4 of the fourth region E4 are, for example, 1.05 to 1.5 times the length L1 of the first region E1.

The length L5 of the first narrow portion 20 is longer than the length L6 of the second narrow portion 22. The length L5 of the first narrow portion 20 is, for example, 1.05 to 1.5 times the length L6 of the second narrow portion 22.

The multi pad 316 has a C surface 24 at each of corner portions of the first region E1, the third region E3, and the fourth region E4. In other words, the corner portions of the first region E1, the third region E3, and the fourth region E4 are cut out. Consequently, the multi pad 316 does not easily separate from the heat storage layer 13 (refer to FIG. 3). The C surface 24 can be produced by designing a printing mask in the production of the multi pad 316.

In the multi pad 316, the length L3 of the third region E3 and the length L4 of the fourth region E4 are longer than the length L1 of the first region E1. Such a configuration easily allows displacement of a probe. That is, even when the position of a probe is displaced, the probe is easily connected to the third region E3 and the fourth region E4.

Although an example in which the length L3 of the third region E3 and the length L4 of the fourth region E4 are longer than the length L1 of the first region E1 is presented, only the length L3 of the third region E3 may be longer than the length L1 of the first region E1. Only the length L4 of the fourth region E4 may be longer than the length L1 of the first region E1.

Although no illustration is provided, the length L4 of the fourth region E4 may be shorter than the length L3 of the third region E3. Such a configuration enables the third region E3 to be placed close to the first region E1. Consequently, accuracy in an electrical inspection in the first probing can be improved. That is, an electric resistance value measured in the third region E3 can be close to an electric resistance value measured in the first region E1, which improves accuracy in inspections.

In this case, the length L3 of the fourth region E4 is, for example, 1.05 to 1.5 times the length L1 of the first region E1.

The length L5 of the first narrow portion 20 may be longer than the length L6 of the second narrow portion 22. Such a configuration increases the distance between the first region E1 and the second region E2. Consequently, a probe does not easily come into contact with the first region E1, and the multi pad 316 is not easily damaged.

Embodiments according to the present invention have been described above. The present invention is, however, not limited to the aforementioned embodiments and can be variously changed as long as not departing from the gist of the present invention. For example, although the thermal printer Z1 that uses the thermal head X1 in the first embodiment is presented, the thermal printer Z1 is not limited thereto and may use the thermal head X2.

For example, although a thin head in which the electric resistance layer 15 is formed to be a thin film to make the heat generating portions 9 thin is presented as an example, the head is not limited thereto. The present invention may be used in a thick film head in which, after the various electrodes are subjected to patterning, the electric resistance layer 15 is formed to be a thick film to make the heat generating portions 9 thick. The heat generating portions 9 may be formed by providing the electric resistance layer 15 only between the common electrode 17 and the individual electrodes 19.

Although a flat-surface head in which the heat generating portions 9 are formed on the substrate 7 is presented as an example and described, the present invention may be used in an end-surface head in which the heat generating portions 9 are provided at an end surface of the substrate 7.

The sealing member 12 may be formed by the same material as the material of the cover member 29 that covers the driving ICs 11. In this case, when the cover member 29 is subjected to printing, printing may be also performed on a region in which the sealing member 12 is formed, and the cover member 29 and the sealing member 12 may be formed at the same time.

The invention claimed is:

1. A thermal head, comprising:

a substrate;

a plurality of heat generating portions positioned on the substrate and arranged in a main scanning direction;

an electrode positioned on the substrate and electrically coupled to each of the plurality of heat generating portions;

a driving IC that drives the plurality of heat generating portions;

a wire that couples the driving IC and the electrode to each other; and a pad positioned on the substrate and coupled to the electrode, the pad being a plurality of pads, and at least one of the plurality of pads is a multi pad having a first region to which the wire is connected, and a second region to which each of a plurality of probes is connected, wherein the second region has a third region to which a first probe of the plurality of probes is connected, and a fourth region to which a second probe of the plurality of probes is connected, the plurality of pads have a plurality of pad rows each having two or more pads arranged in the main scanning direction, the plurality of pad rows being arranged in a sub-scanning direction, a pad that constitutes a first pad row positioned adjacent to the plurality of heat generating portions is the multi pad, and a pad that constitutes a second pad row positioned away from the plurality of heat generating portions is a single pad having a first connection region to which the wire is connected and a second connection region to which one of the plurality of probes is connected.

2. The thermal head according to claim 1,
wherein
in each of the plurality of pads, a length of the third region or the fourth region is longer than a length of the first region in the sub-scanning direction.

3. The thermal head according to claim 1,
wherein, in each of the plurality of pads,
the first region and the fourth region are adjacent to each other in the sub-scanning direction, and
a length of the fourth region is shorter than a length of the third region in the sub-scanning direction.

4. The thermal head according to claim 2,
wherein the plurality of pads each have
a first narrow portion that connects the first region and the second region to each other, and
a second narrow portion that connects the third region and the fourth region to each other, and
wherein a length of the first narrow portion is longer than a length of the second narrow portion in the sub-scanning direction.

5. A thermal printer, comprising:
the thermal head according to claim 1;
a transport mechanism configured to transport a recording medium onto the heat generating portions; and
a platen roller configured to press the recording medium.

6. A thermal head, comprising:
a substrate;
a plurality of heat generating portions positioned on the substrate and arranged in a main scanning direction;
an electrode positioned on the substrate and electrically coupled to each of the plurality of heat generating portions;
a driving IC that drives the plurality of heat generating portions;
a wire that couples the driving IC and the electrode to each other; and
a pad positioned on the substrate and coupled to the electrode, the pad being a plurality of pads, and at least one of the plurality of pads is a multi pad having
a first region to which the wire is connected, and
a second region to which each of a plurality of probes is connected,
wherein the second region has
a third region to which a first probe is connected, and
a fourth region to which a second probe is connected; and
in each of the plurality of pads, a length of the third region or a length of the fourth region is longer than a length of the first region in a sub-scanning direction.

7. The thermal head according to claim 6, wherein, in each of the plurality of pads,
the first region and the fourth region are adjacent to each other in the sub-scanning direction, and
the length of the fourth region is shorter than the length of the third region in the sub-scanning direction.

8. The thermal head according to claim 6,
wherein the plurality of pads each have
a first narrow portion that connects the first region and the second region to each other, and
a second narrow portion that connects the third region and the fourth region to each other, and
wherein a length of the first narrow portion is longer than a length of the second narrow portion in the sub-scanning direction.

9. A thermal printer, comprising:
the thermal head according to claim 6;
a transport mechanism configured to transport a recording medium onto the heat generating portions; and
a platen roller configured to press the recording medium.

10. A thermal head, comprising:
a substrate;
a plurality of heat generating portions positioned on the substrate and arranged in a main scanning direction;
an electrode positioned on the substrate and electrically coupled to each of the plurality of heat generating portions;
a driving IC that drives the plurality of heat generating portions;
a wire that couples the driving IC and the electrode to each other; and
a pad positioned on the substrate and coupled to the electrode, the pad being a plurality of pads, and at least one of the plurality of pads is a multi pad having
a first region to which the wire is connected, and
a second region to which each of a plurality of probes is connected,
wherein the second region has
a third region to which a first probe is connected, and
a fourth region to which a second probe is connected, and
in each of the plurality of pads,
the first region and the fourth region are adjacent to each other in a sub-scanning direction, and
a length of the fourth region is shorter than a length of the third region in the sub-scanning direction.

11. The thermal head according to claim 10,
wherein the plurality of pads each have
a first narrow portion that connects the first region and the second region to each other, and
a second narrow portion that connects the third region and the fourth region to each other, and
wherein a length of the first narrow portion is longer than a length of the second narrow portion in the sub-scanning direction.

12. A thermal printer, comprising:
the thermal head according to claim 10;
a transport mechanism configured to transport a recording medium onto the heat generating portions; and
a platen roller configured to press the recording medium.

* * * * *